US007861328B1

(12) United States Patent
Joo et al.

(10) Patent No.: US 7,861,328 B1
(45) Date of Patent: Jan. 4, 2011

(54) TOILET SEAT TILTING DEVICE

(76) Inventors: Young Han Joo, 16403 Harvest Ave., Norwalk, CA (US) 90650; Susie Rana Joo, 16403 Harvest Ave., Norwalk, CA (US) 90650; Jung Chan Joo, 16403 Harvest Ave., Norwalk, CA (US) 90650

( * ) Notice: Subject to any disclaimer, the term of this patent is extended or adjusted under 35 U.S.C. 154(b) by 0 days.

(21) Appl. No.: 11/857,568

(22) Filed: Sep. 19, 2007

(51) Int. Cl.
*A47K 13/10* (2006.01)

(52) U.S. Cl. ..... 4/246.1; 4/246.3; 4/246.4

(58) Field of Classification Search ..... 4/246.1, 4/246.3–246.5, 248, 667
See application file for complete search history.

(56) References Cited

U.S. PATENT DOCUMENTS 1,276,472 A * 8/1918 Zeen ..... 4/246.4
5,594,958 A * 1/1997 Nguyen ..... 4/246.5
7,254,846 B2 * 8/2007 Kim ..... 4/246.3

* cited by examiner

*Primary Examiner*—Tuan N Nguyen
(74) *Attorney, Agent, or Firm*—John K. Park; Park Law Firm

(57) ABSTRACT

A toilet seat tilting device includes a base, a seat tilting device that lifts or lowers a seat and a seat cover tilting device that lifts or lowers the seat cover. First and second pedals are used to operate link mechanisms. When the first pedal is pressed, the parts of the seat tilting device are rotated clockwise so that the seat is lifted. When the second pedal is pressed, the parts are rotated counterclockwise so that the seat is lowered. The seat cover is lowered when the second pedal is further pressed. The height of the tilting devices is adjustable and they are provided in left-handed and right-handed structures to be adapted various toilets.

11 Claims, 20 Drawing Sheets

TOILET SEAT TILTING DEVICE

CROSS REFERENCE TO RELATED APPLICATION

The present invention is an improvement over U.S. Ser. No. 10/838,883 filed on May 4, 2004, the contents of which are incorporated by reference as if fully set forth herein.

BACKGROUND OF THE INVENTION

The present invention relates to a toilet seat tilting device. More particularly, this invention relates to a hands-off toilet tilting device that can tilt up or down the toilet seat with simple and reliable mechanism.

There are many toilet seat tilting devices by prior art.

U.S. Pat. No. 1,099,801 to N. Hirsch discloses a combination of rods and hinges to close and open the toilet seat.

U.S. Pat. No. 1,333,747 to Yoshinaga discloses use of a foot lever to manually open and close the toilet seat.

U.S. Pat. No. 1,877,083 to L. C. Thrasher and U.S. Pat. No. 5,594,958 to L. N. Nguyen disclose use of two foot levers.

None of the prior art devices were satisfactory in the aspects of ease of installation, adjustability to different size of toilets, smooth operability, and simple mechanism.

SUMMARY OF THE INVENTION

The present invention contrives to solve the disadvantages of the prior art.

An objective of the invention is to provide a toilet seat tilting device that provides smooth and effortless operation of opening or closing toilet seat.

Another objective of the invention is to provide a toilet seat tilting device that can be installed without modifying existing toilets.

Still another objective of the invention is to provide a toilet seat tilting device that can be adjusted to fit various size of toilets.

Still another objective of the invention is to provide a toilet seat tilting device that is easy to install to existing toilets.

To achieve the above objectives, the present invention provides a toilet seat tilting device that tilts up and down a seat and a seat cover of a toilet. The device includes a base, a seat tilting device that is adapted to lift or lower the seat and a seat cover tilting device that is adapted to lift or lower the seat cover.

The base comprises a bottom and a column that extends from the bottom.

The seat cover tilting device comprises a cam member that is pivotally attached to the base, a first link assembly, and a head assembly that is pivotally attached to the column. The first link assembly is pivotally attached to the cam member and the head assembly. The head assembly is rotated counterclockwise when the left pedal is pressed whereby the seat cover is lowered.

The seat tilting device comprises a first pedal that is pivotally attached to the base, a second pedal that is pivotally attached to the base, an angle bar that is pivotally attached to the base, a second link assembly, and a mouth that is pivotally attached to the column. The second link assembly is pivotally attached to the angle bar and the mouth. The mouth is adapted to be fixed to the seat. When the second pedal is pressed, the angle bar and the mouth are rotated clockwise whereby the seat is lifted. When the first pedal is pressed, the angle bar and the mouth are rotated counterclockwise whereby the seat is lowered.

The seat tilting device further comprises an upper base that is adapted to fix the seat. The upper base comprises an elongate and bent plate that extends parallel with the axis of the rotating of the mouth.

The first pedal comprises a first pedal foot end and a first pedal actuating end. When the first pedal foot end is pressed, the first pedal is rotated counterclockwise and the first pedal actuating end presses the angle bar of the seat tilting device and the cam member of the seat cover tilting device counterclockwise whereby the seat and the seat cover are lowered.

The column comprises a lower cover assembly and an upper cover assembly. The upper cover assembly is partially received in the lower cover assembly. The height of the column is adjustable by adjusting the length of the portion of the upper cover assembly that is received in the lower cover assembly.

The length of the first link assembly is adjustable.

The length of the second link assembly is adjustable.

The seat tilting device further comprises a link block that pivotally connects between the second pedal and the angle bar.

The seat cover tilting device further comprises a head holder that is pivotally connected to the head assembly.

The base further comprises a first rail on which the cam member of the seat cover tilting device is pivotally attached, and a second rail on which the angle bar of the seat tilting device is attached.

The seat tilting device is adapted to be installed on the left side of the toilet.

The seat tilting device is adapted to be installed on the right side of the toilet.

The advantages of the present invention are: (1) a simple and smoothly operating, toilet seat tilting device is provided; (2) the device does not need modification of a toilet to install; (3) the device is adaptable to various toilets having different sizes.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
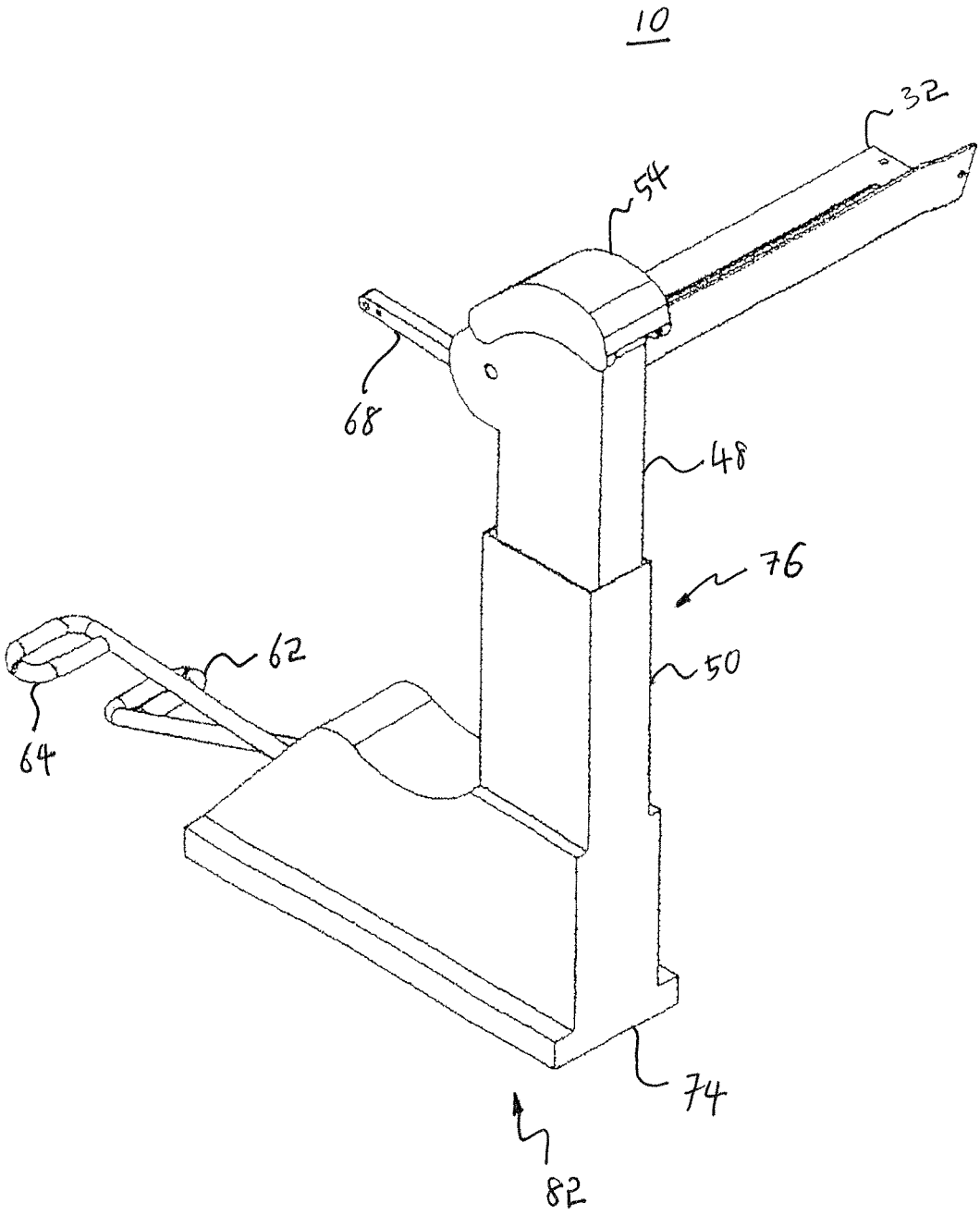
FIG. 1 is a perspective view of a toilet seat tilting device of the present invention.
Figure 2:
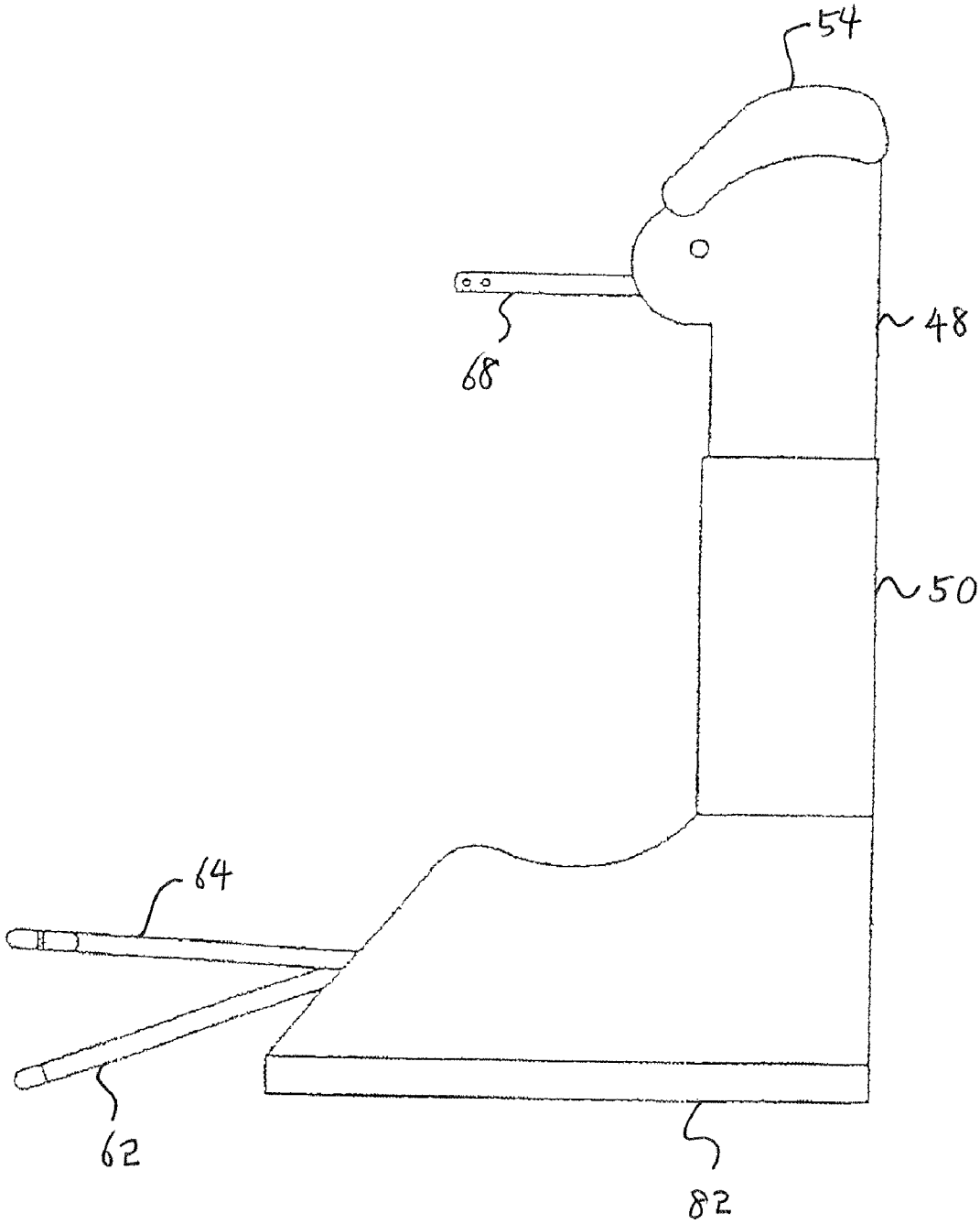
FIG. 2 is an elevation view of the toilet seat tilting device.
Figure 25:
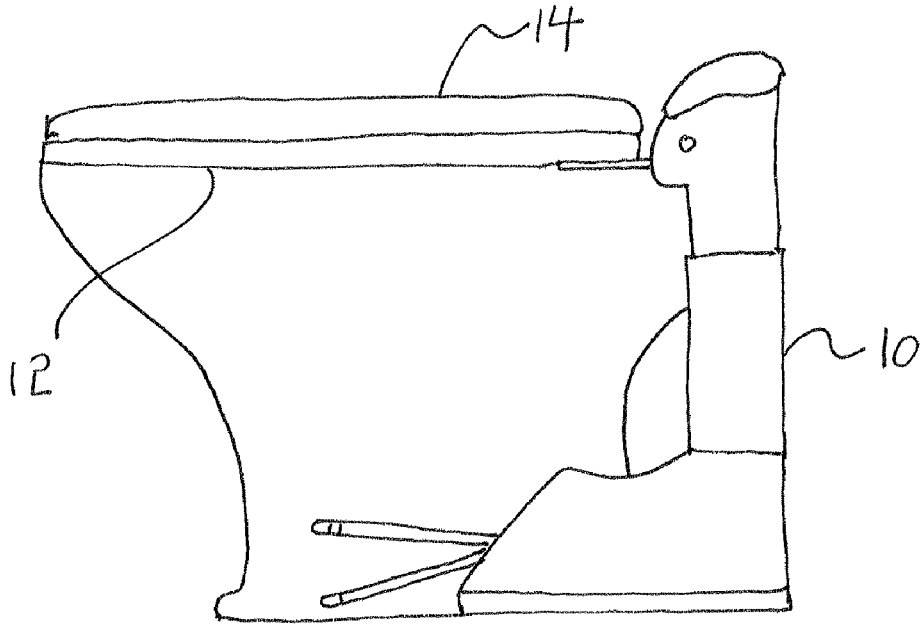
FIG. 25 is a perspective view of a toilet and the toilet seat tilting device.

FIGS. 1, 2 and 25 show a toilet seat tilting device 10 that tilts up and down a seat 12 and a seat cover 14 of a toilet. The toilet seat tilting device 10 includes a base 82, a seat tilting device 78 that is adapted to lift or lower the seat 12 and a seat cover tilting device 80 that is adapted to lift or lower the seat cover 14.

The base 82 comprises a bottom 74 and a column 76 that extends from the bottom 74.

Figure 3:
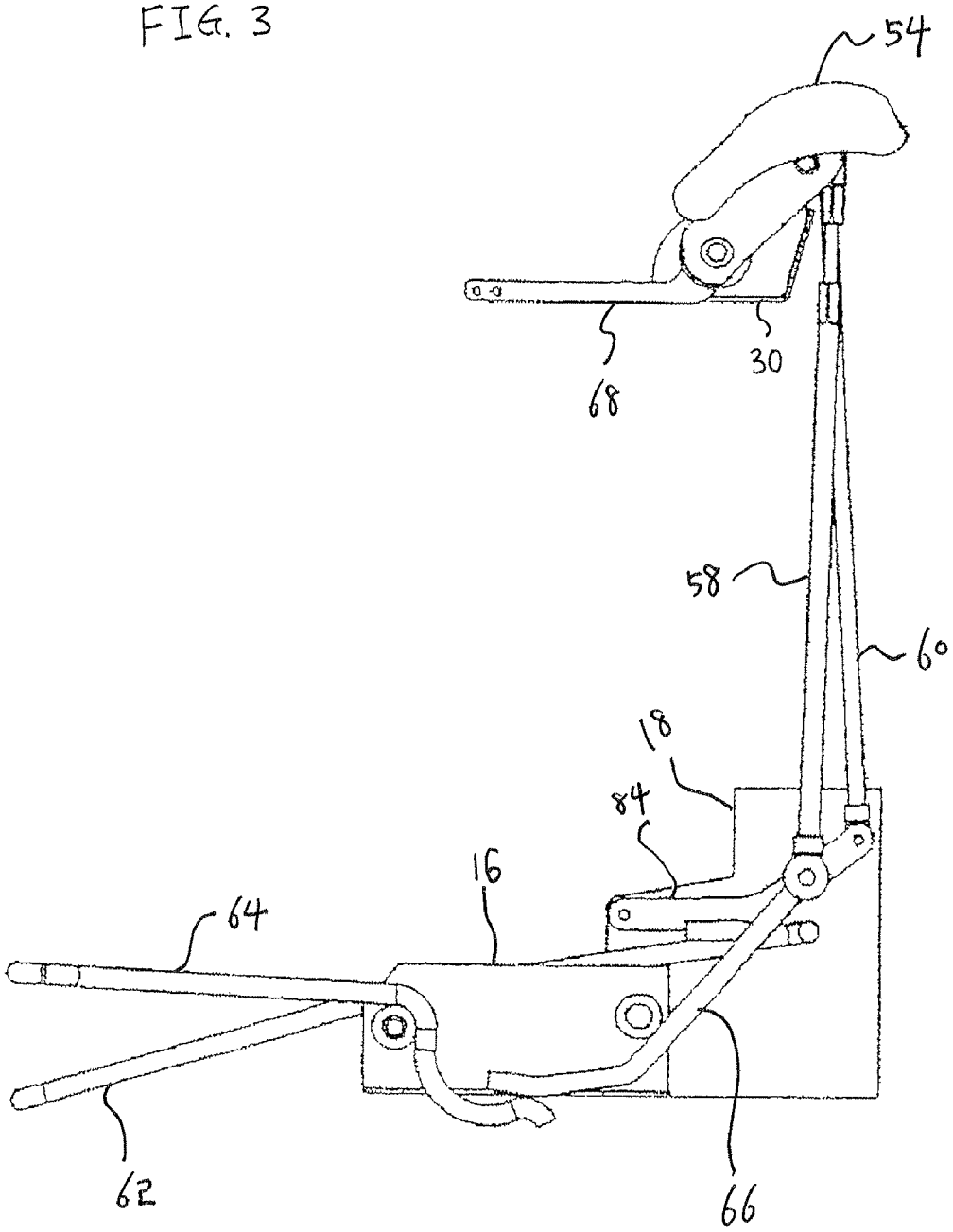
FIG. 3 is an elevation view of the toilet seat tilting device showing mechanisms for tiling and lowering seat and seat cover with the seat in lowered position.
Figure 5:
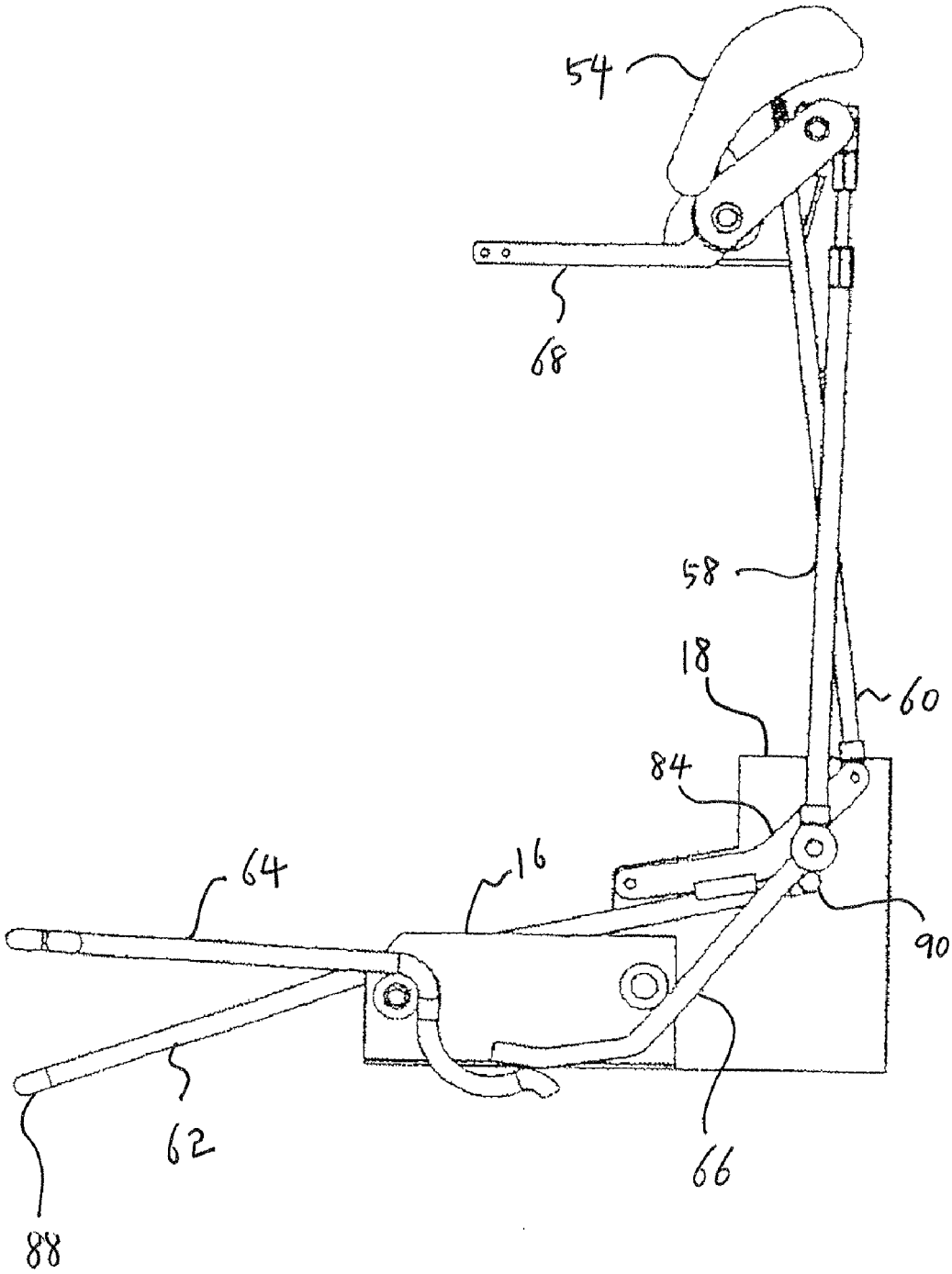
FIG. 5 is an elevation view of the toilet seat tilting device with the seat and seat cover in lowered position.
Figure 8:
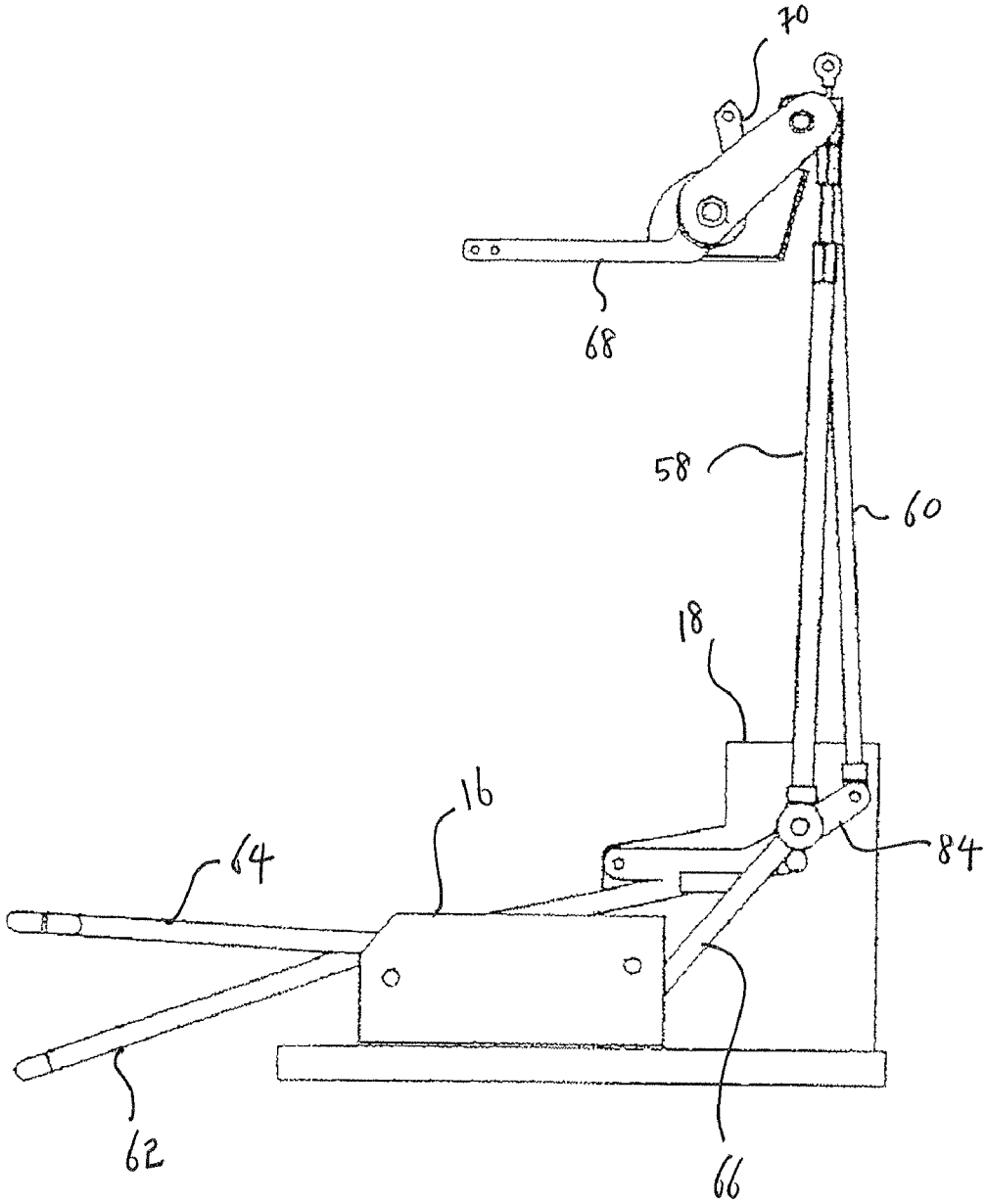
FIG. 8 is an elevation view of the toilet seat tilting device with a head cover.
Figure 29:
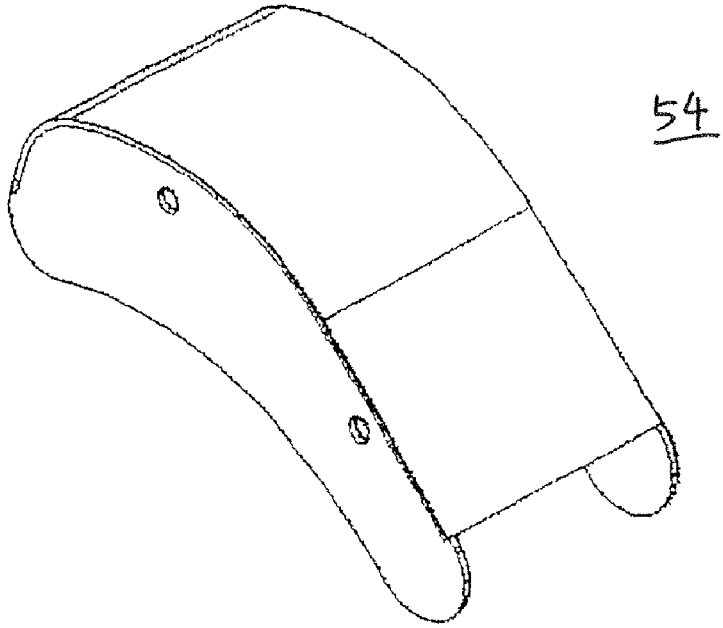
FIG. 29 is a perspective view of a head assembly.

FIG. 3 shows that the seat cover tilting device 80 comprises a cam member 84 that is pivotally attached to the base 82, a first link assembly 60, and a head assembly 54 (refer to FIG. 29) that is pivotally attached to the column 76. The first link assembly 60 is pivotally attached to the cam member 84 and the head assembly 54. FIGS. 5 and 8 show that the head assembly 54 is rotated counterclockwise when a first pedal 62 (refer to FIG. 34) is pressed whereby the seat cover 14 is lowered.

Figure 4:
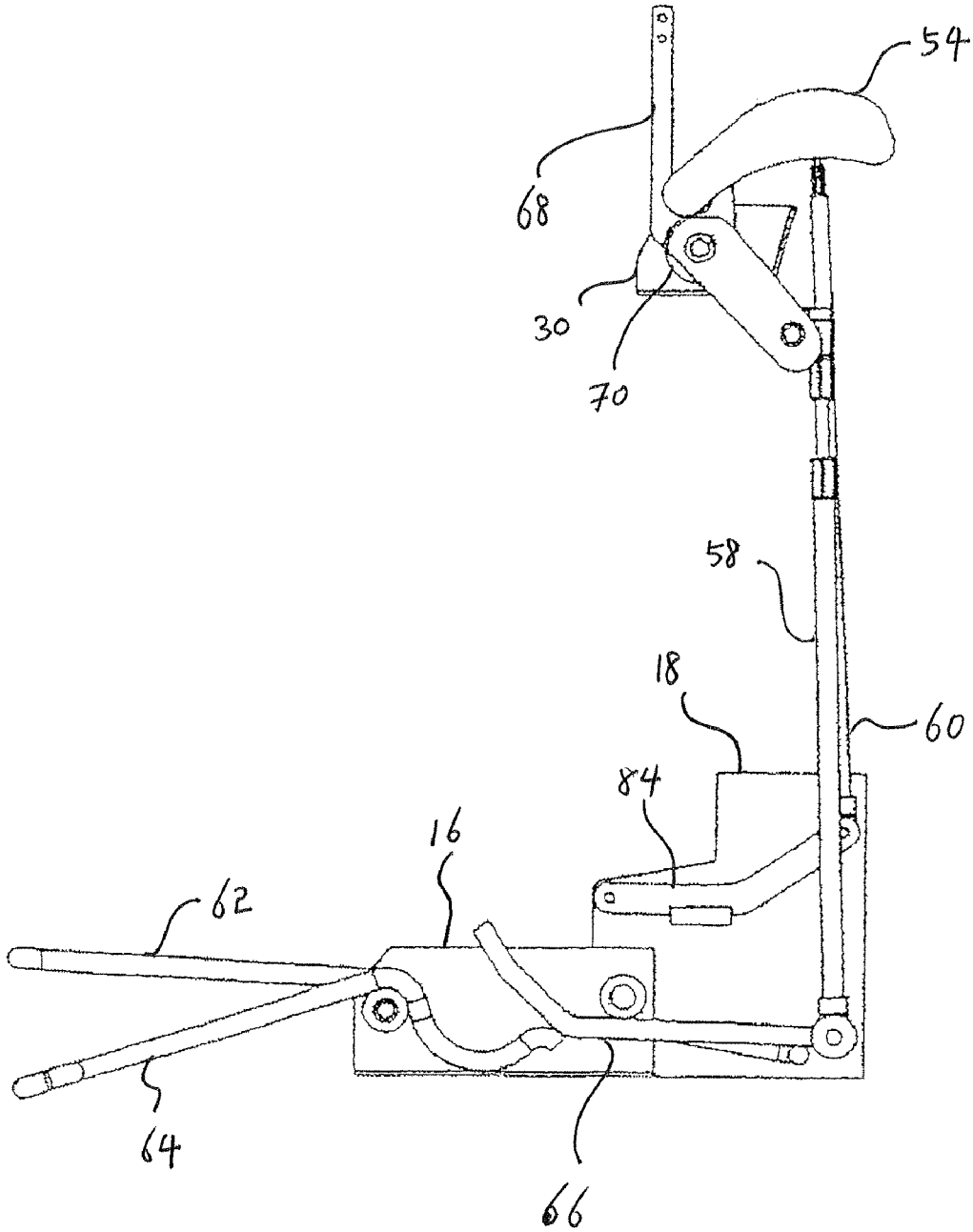
FIG. 4 is an elevation view of the toilet seat tilting device with the seat in lifted position.
Figure 17:
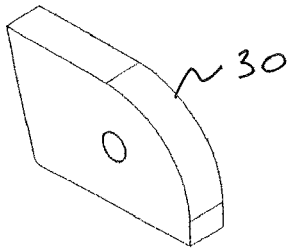
FIG. 17 is a perspective view of an upper base side.
Figure 35:
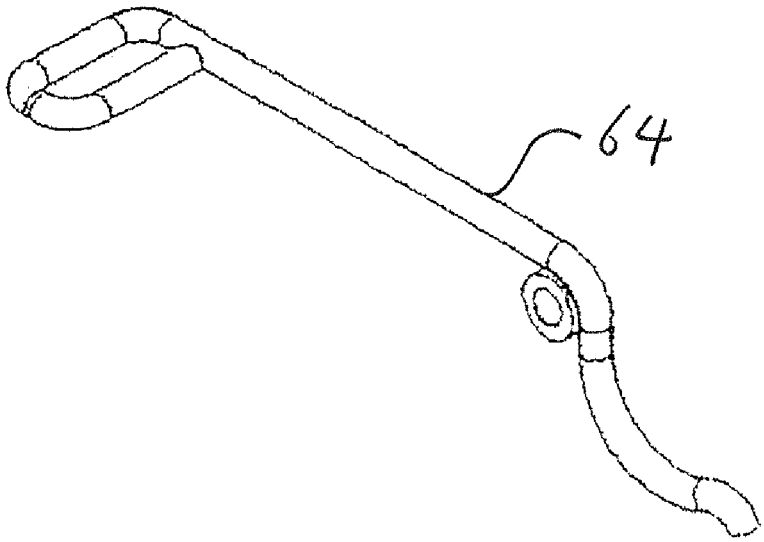
FIG. 35 is a perspective view of a right pedal.
Figure 36:
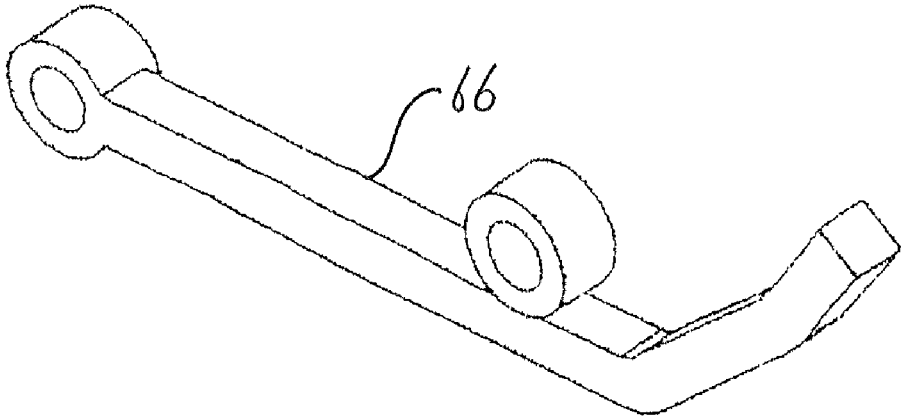
FIG. 36 is a perspective view of an angle bar.
Figure 37:
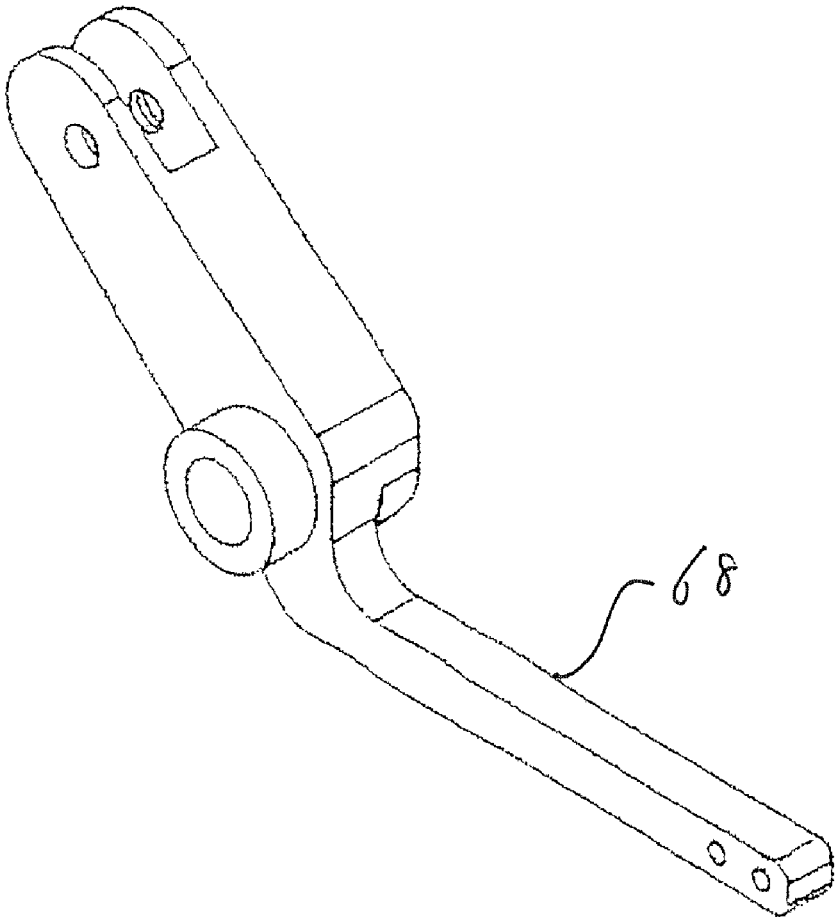
FIG. 37 is a perspective view of a mouth.

The seat tilting device 78 comprises the first pedal 62 that is pivotally attached to the base 82, a second pedal 64 (refer to FIG. 35) that is pivotally attached to the base 82, an angle bar 66 (refer to FIG. 36) that is pivotally attached to the base 82, a second link assembly 58, and a mouth 68 (refer to FIG. 37) that is pivotally attached to the column 76. The second link assembly 58 is pivotally attached to the angle bar 66 and the mouth 68. The mouth 68 is adapted to be fixed to the seat 12. As shown in FIG. 4, when the second pedal 64 is pressed, the angle bar 66 and the mouth 68 are rotated clockwise whereby the seat 12 is lifted. As shown in FIG. 5, when the first pedal 62 is pressed, the angle bar 66 and the mouth 68 are rotated counterclockwise whereby the seat 12 is lowered. The toilet seat tilting device 10 further comprises an upper base side 30 (refer to FIG. 17) that helps to support the mouth 68 and the head holder 70.

Figure 6:
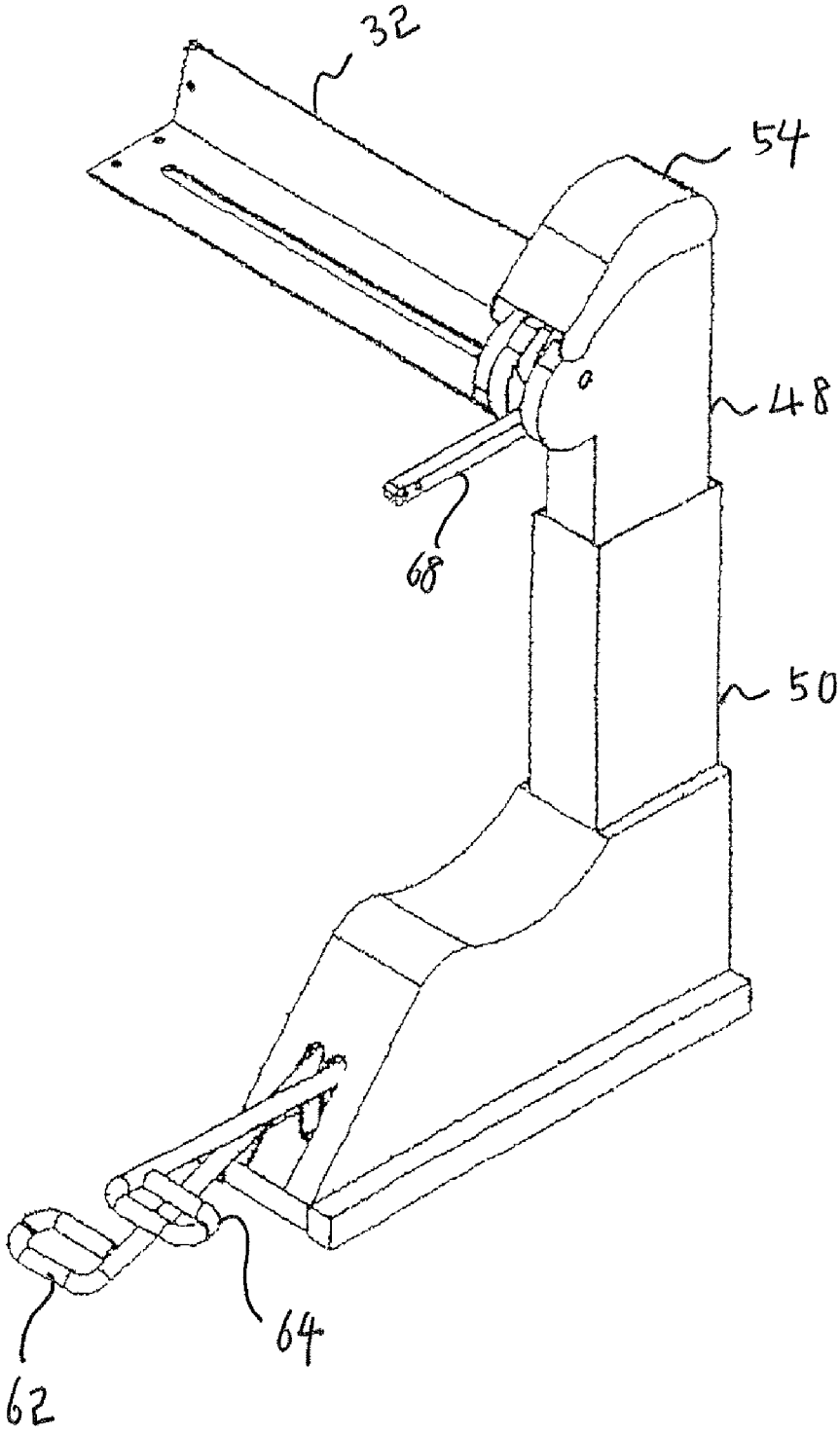
FIG. 6 is a perspective view of the toilet seat tilting device viewed in another direction.
Figure 7:
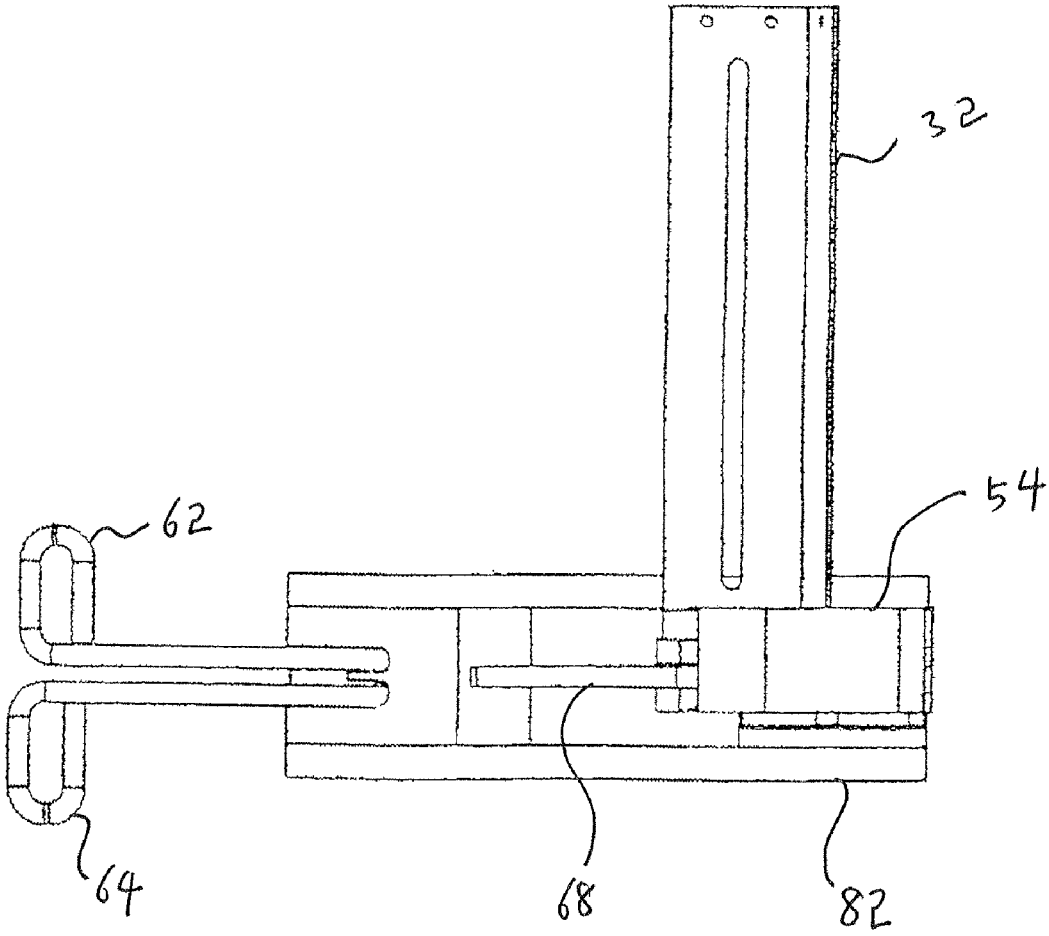
FIG. 7 is a plan view of the toilet seat tilting device.
Figure 18:
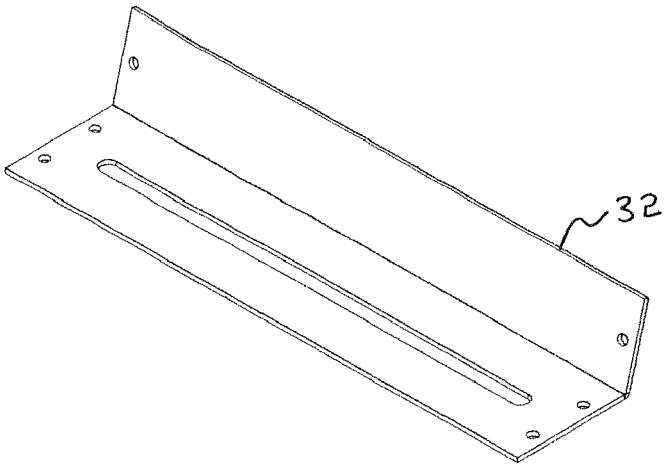
FIG. 18 is a perspective view of an upper base.
Figure 24:
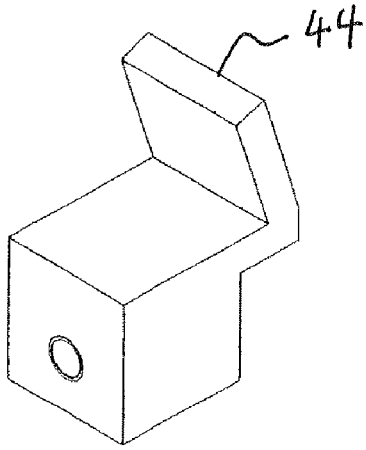
FIG. 24 is a perspective view of a seat holder.

FIGS. 6 and 7 show that the seat tilting device 78 further comprises an upper base 32 (refer to FIG. 18) that is adapted to fix the seat 12, and a seat holder 44 (refer to FIG. 24). The upper base 32 comprises an elongate and bent plate that extends parallel with the axis of the rotating of the mouth 68.

Figure 34:
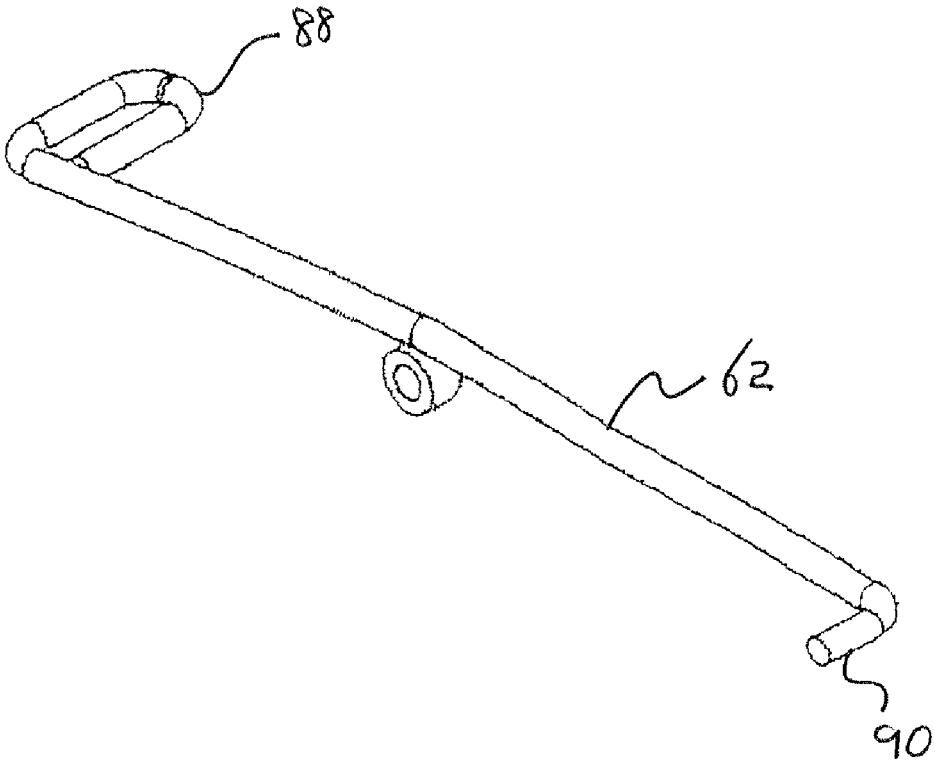
FIG. 34 is a perspective view of a left pedal.

FIG. 34 shows that the first pedal 62 comprises a first pedal foot end 88 and a first pedal actuating end 90. As shown in FIG. 5, when the first pedal foot end 88 is pressed, the first pedal 62 is rotated counterclockwise and the first pedal actuating end 90 presses the angle bar 66 of the seat tilting device 78 and the cam member 84 of the seat cover tilting device 80 counterclockwise whereby the seat 12 and the seat cover 14 are lowered.

Figure 19:
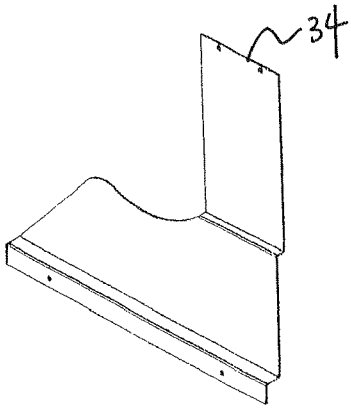
FIG. 19 is a perspective view of a lower cover right.
Figure 20:
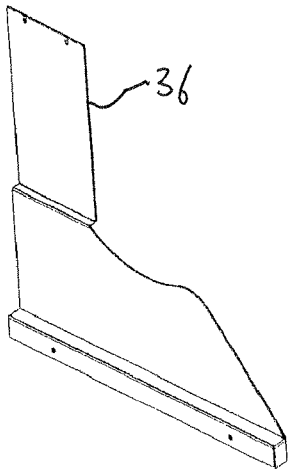
FIG. 20 is a perspective view of a lower cover left.
Figure 21:
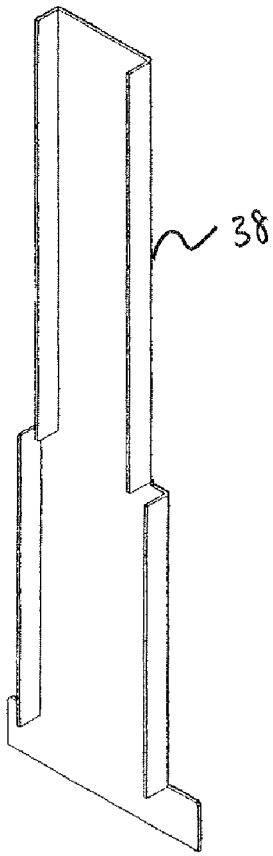
FIG. 21 is a perspective view of a lower cover rear.
Figure 22:
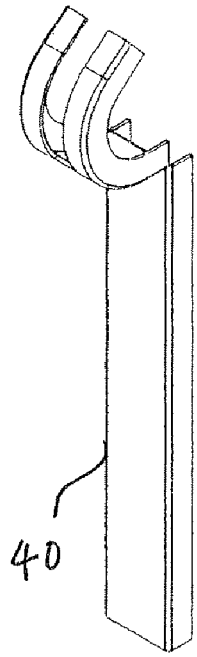
FIG. 22 is a perspective view of an upper cover front.
Figure 23:
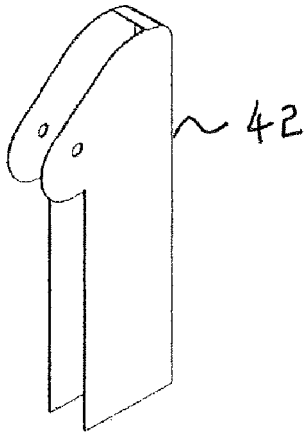
FIG. 23 is a perspective view of an upper cover rear.
Figure 26:
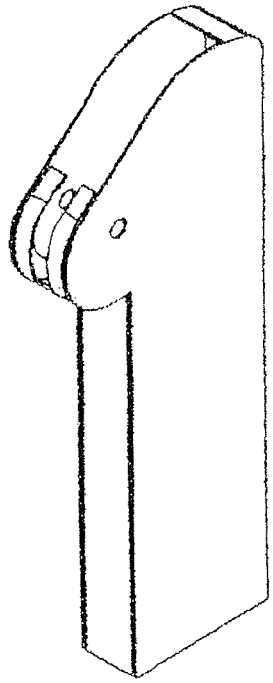
FIG. 26 is a perspective view of an upper cover assembly.
Figure 27:
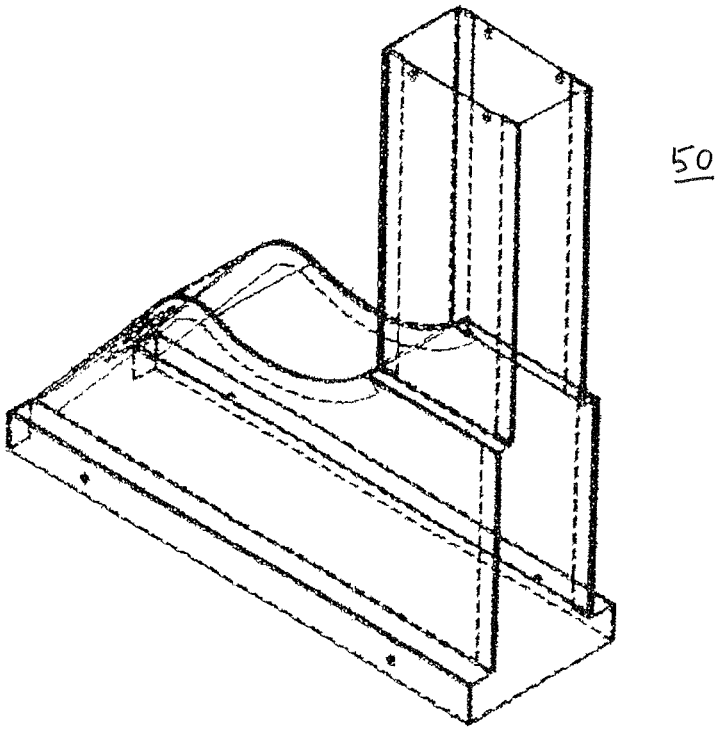
FIG. 27 is a perspective view of a lower cover assembly.

Referring back to FIGS. 1, 26 and 27, the column 76 comprises a lower cover assembly 50 and an upper cover assembly 48. The upper cover assembly 48 is partially received in the lower cover assembly 50. The height of the column 76 is adjustable by adjusting the length of the portion of the upper cover assembly 48 that is received in the lower cover assembly 50. In this embodiment, the height of the column is adjustable from 16 to 22 inches. The lower cover assembly 50 comprises a lower cover right 34 (refer to FIG. 19), a lower cover left 36 (refer to FIG. 20) and a lower cover rear 38 (refer to FIG. 21). The upper cover assembly 48 comprises an upper cover front 40 (refer to FIG. 22) and an upper cover rear 42 (refer to FIG. 23).

Figure 15:
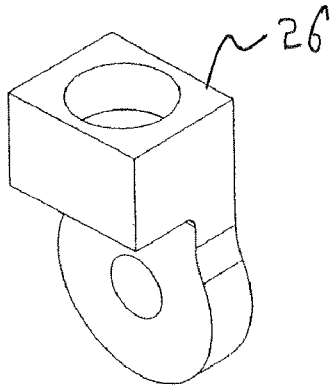
FIG. 15 is a perspective view of a head link bottom end.
Figure 16:
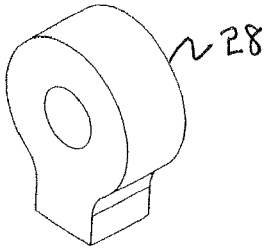
FIG. 16 is a perspective view of a head link top end.
Figure 32:
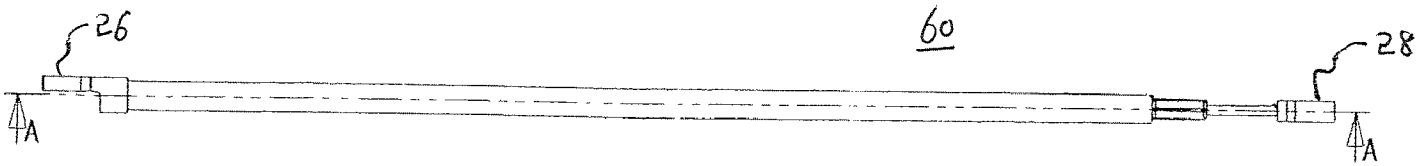
FIG. 32 is an elevation view of a left link assembly.
Figure 33:
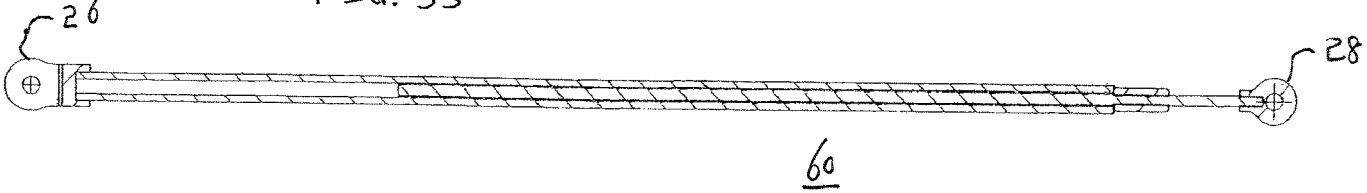
FIG. 33 is a cross-sectional view of the left link assembly taken along line A-A in FIG. 32.

As shown in FIGS. 32 and 33, the length of the first link assembly 60 is adjustable. The first link assembly 60 comprises a bottom end 26 (refer to FIG. 15) and a top end 28 (refer to FIG. 16).

Figure 13:
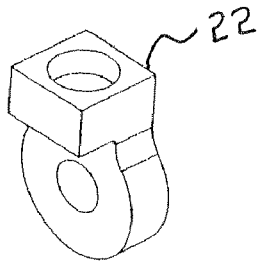
FIG. 13 is a perspective view of a right link end.
Figure 14:
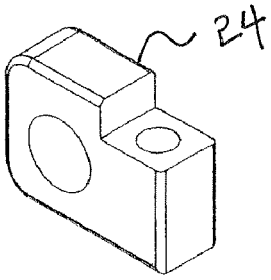
FIG. 14 is a perspective view of a right link hinge.
Figure 31:
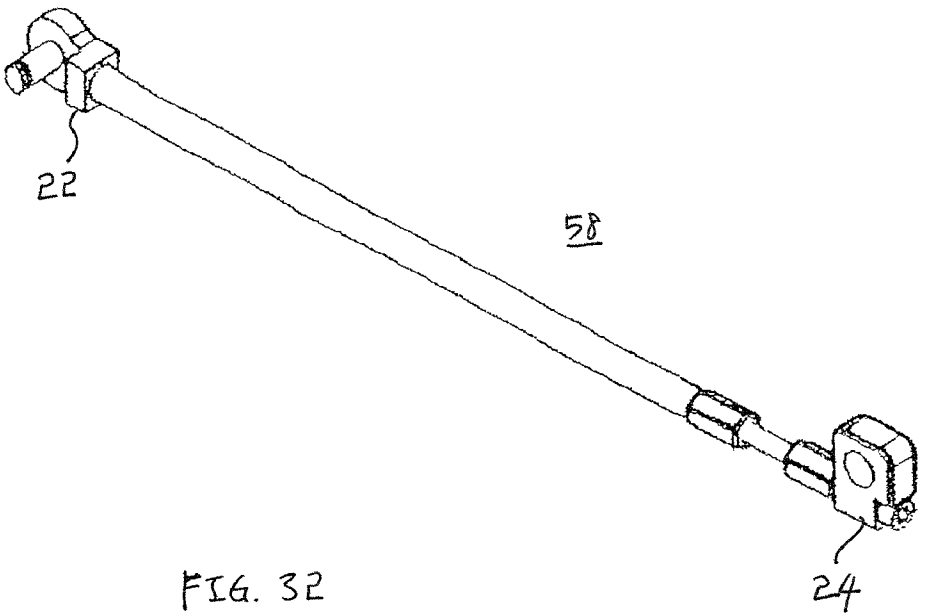
FIG. 31 is a perspective view of a right link assembly.

As shown in FIG. 31, the length of the second link assembly 58 is adjustable. The second link assembly 58 comprises a link end 22 (refer to FIG. 13), and a link hinge 24 (refer to FIG. 14).

Figure 9:
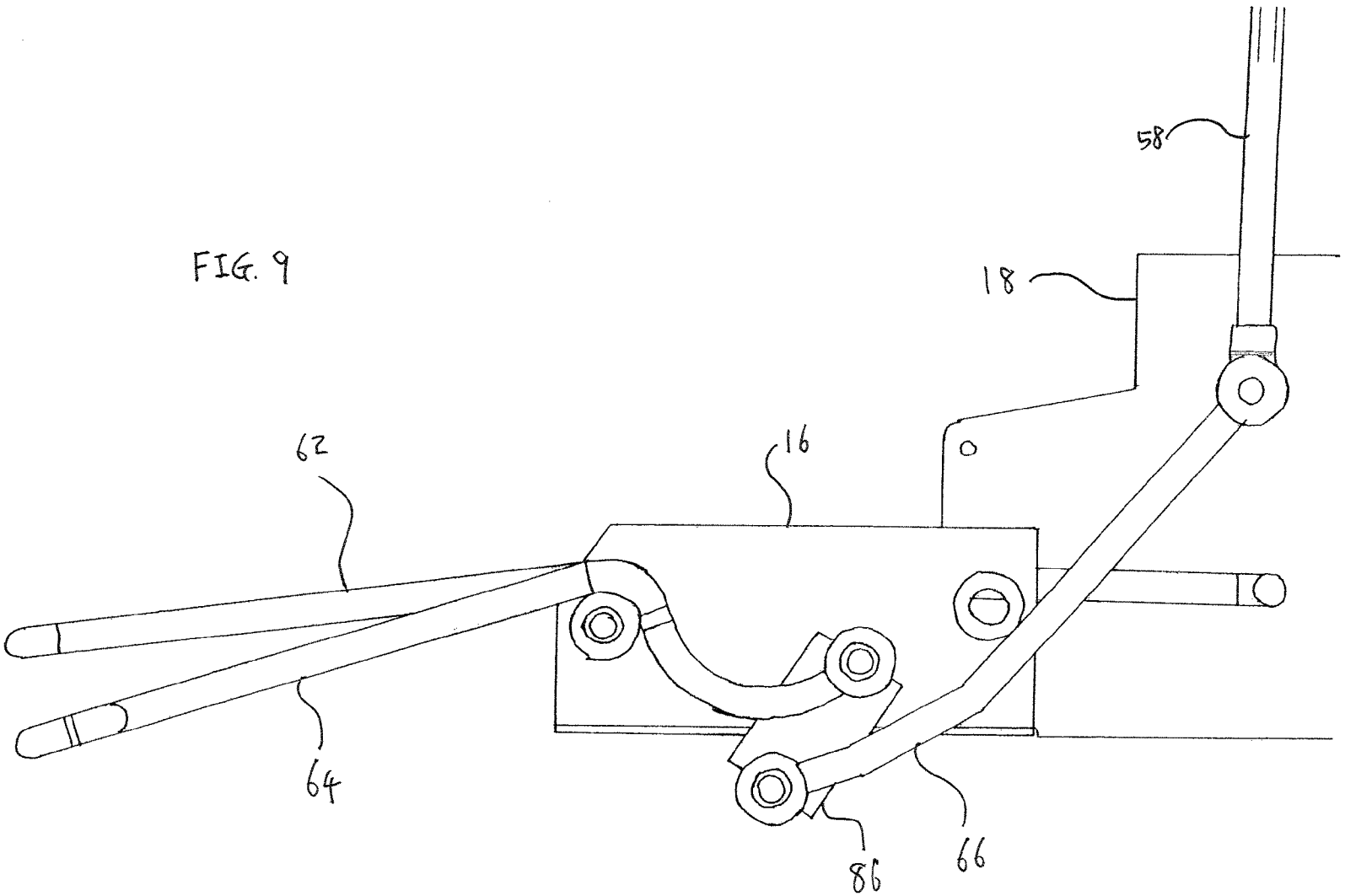
FIG. 9 is a partial elevation view of toilet seat tilting device showing details of the tilting mechanism.

FIG. 9 shows that the seat tilting device 78 further comprises a link block 86 that pivotally connects between the second pedal 64 and the angle bar 66.

Figure 38:
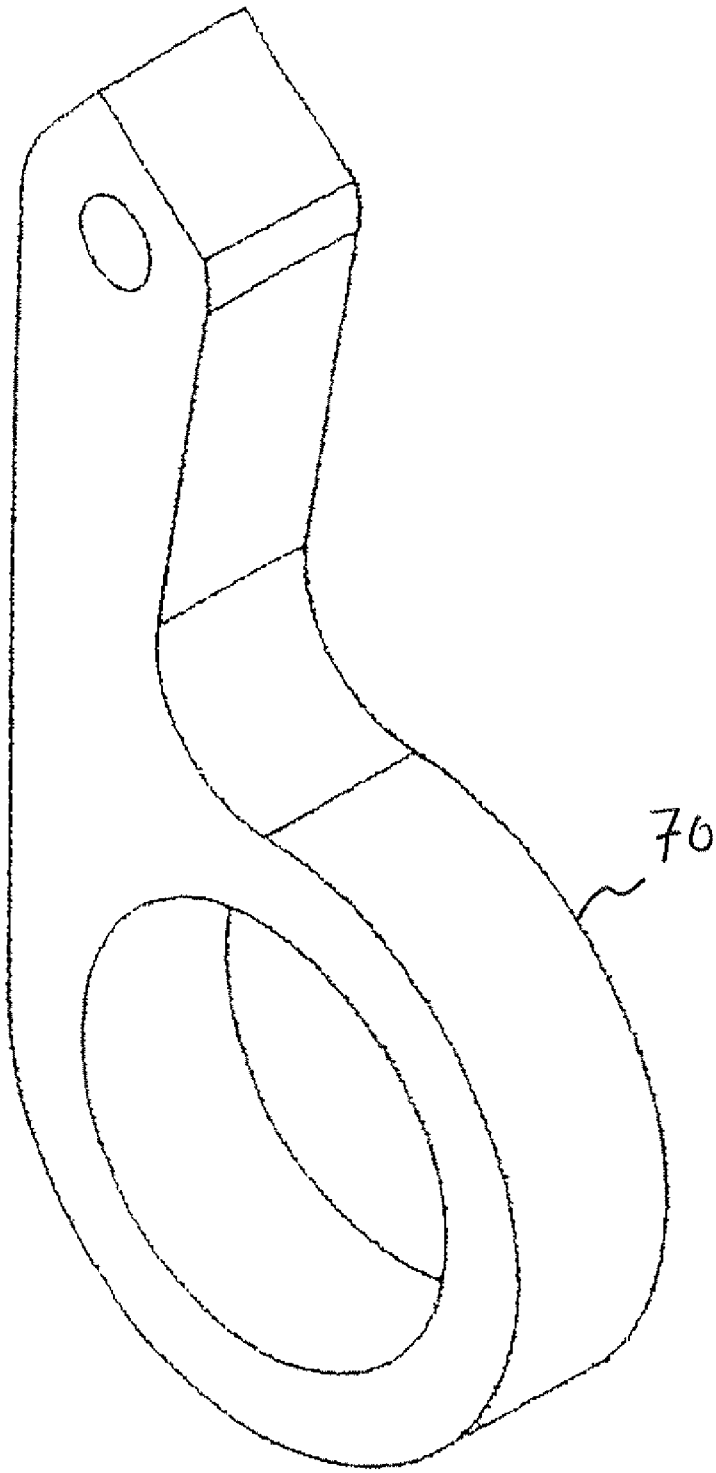
FIG. 38 is a perspective view of a head holder.

FIGS. 4 and 38 show that the seat cover tilting device 80 further comprises a head holder 70 that is pivotally connected to the head assembly 54.

Figure 10:
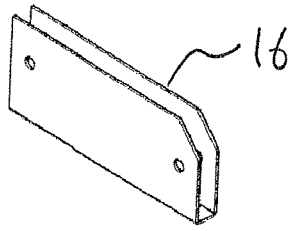
FIG. 10 is a perspective view of a right rail.
Figure 11:
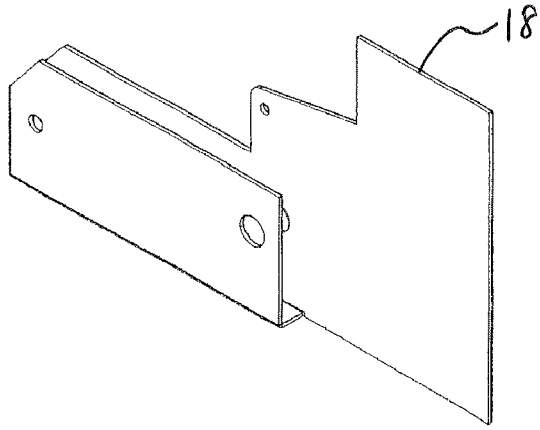
FIG. 11 is a perspective view of a left rail.
Figure 12:
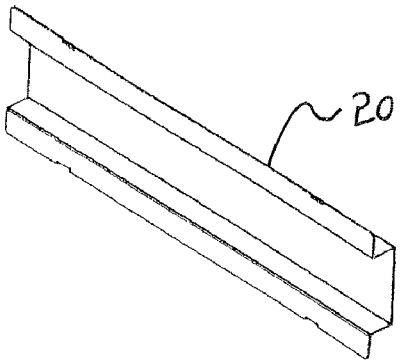
FIG. 12 is a perspective view of a bottom cover.
Figure 28:
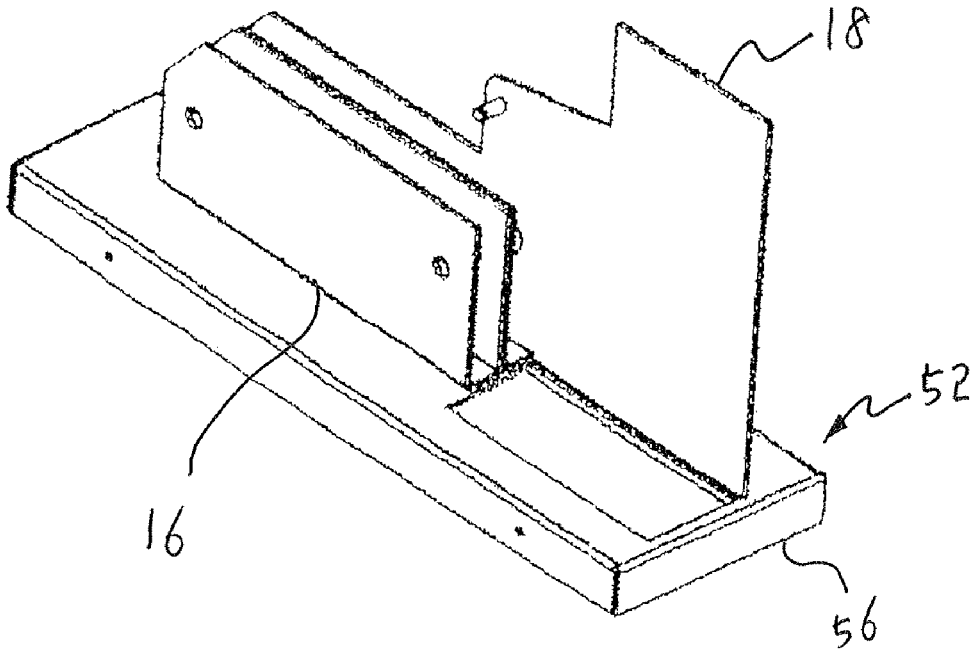
FIG. 28 is a perspective view of a bottom assembly.
Figure 30:
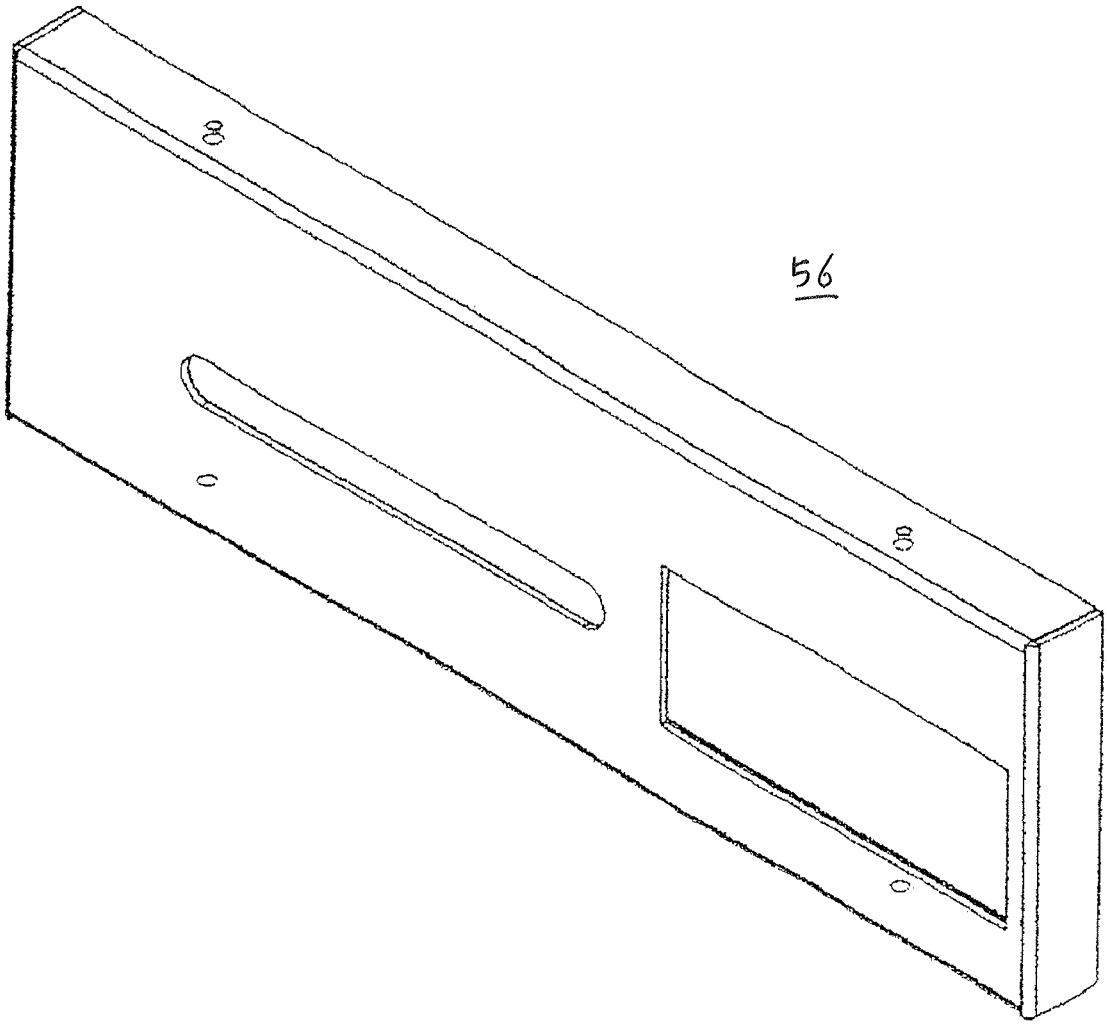
FIG. 30 is a perspective view of a bottom base.

FIGS. 10, 11 and 28 show that the base 82 further comprises a first rail 18 on which the cam member 84 of the seat cover tilting device 80 is pivotally attached, and a second rail 16 on which the angle bar 66 of the seat tilting device 78 is attached. A bottom assembly 52 comprises a bottom base 56 (refer FIG. 30) and a bottom cover 20 (refer to FIG. 12).

FIG. 25 shows that the seat tilting device 10 is adapted to be installed on the right side of the toilet. The seat tilting device 10 may also be provided as being adapted to be installed on the left side of the toilet.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A toilet seat tilting device, wherein a seat and a seat cover of a toilet are tilted up or down by the toilet seat tilting device, the device comprising:

a) a base;

b) a seat tilting device that is adapted to lift or lower the seat; and c) a seat cover tilting device that is adapted to lift or lower the seat cover;

wherein the base comprises a bottom and a column that extends from the bottom;

wherein the seat cover tilting device comprises a cam member that is pivotally attached to the base, a first link assembly, and a head assembly that is pivotally attached to the column, wherein the first link assembly is pivotally attached to the cam member and the head assembly, wherein the head assembly is rotated counterclockwise when a first pedal is pressed whereby the seat cover is lowered;

wherein the seat tilting device comprises the first pedal that is pivotally attached to the base, a second pedal that is pivotally attached to the base, an angle bar that is pivotally attached to the base, a second link assembly, a mouth that is pivotally attached to the column, wherein the second link assembly is pivotally attached to the angle bar and the mouth, wherein the mouth is adapted to be fixed to the seat, wherein when the second pedal is pressed, the angle bar and the mouth are rotated clockwise whereby the seat is lifted, wherein when the first pedal is pressed, the angle bar and the mouth are rotated counterclockwise whereby the seat is lowered.

2. The toilet seat tilting device of claim 1, wherein the seat tilting device further comprises an upper base that is adapted to fix the seat, wherein the upper base comprises an elongate and bent plate that extends parallel with the axis of the rotating of the mouth.

3. The toilet seat tilting device of claim 1, wherein the first pedal comprises a first pedal foot end and a first pedal actuating end, wherein when the first pedal foot end is pressed, the first pedal is rotated counterclockwise and the first pedal actuating end presses the angle bar of the seat tilting device and the cam member of the seat cover tilting device counterclockwise whereby the seat and the seat cover are lowered.

4. The toilet seat tilting device of claim 1, wherein the column comprises a lower cover assembly and an upper cover assembly, wherein the upper cover assembly is partially received in the lower cover assembly, wherein the height of the column is adjustable by adjusting the length of the portion of the upper cover assembly that is received in the lower cover assembly.

5. The toilet seat tilting device of claim 4, wherein the length of the first link assembly is adjustable.

6. The toilet seat tilting device of claim 4, wherein the length of the second link assembly is adjustable.

7. The toilet seat tilting device of claim 1, wherein the seat tilting device further comprising a link block that pivotally connects between the second pedal and the angle bar.

8. The toilet seat tilting device of claim 1, wherein the seat cover tilting device further comprises a head holder that is pivotally connected to the head assembly.

9. The toilet seat tilting device of claim 1, wherein the base further comprises a first rail on which the cam member of the seat cover tilting device is pivotally attached, and a second rail on which the angle bar of the seat tilting device is attached.

10. The toilet seat tilting device of claim 1, wherein the seat tilting device is adapted to be installed on the left side of the toilet.

11. The toilet seat tilting device of claim 1, wherein the seat tilting device is adapted to be installed on the right side of the toilet.

* * * * *